US011462192B2

(12) United States Patent
Gerdes et al.

(10) Patent No.: US 11,462,192 B2
(45) Date of Patent: Oct. 4, 2022

(54) FLIPPED OR FROZEN DISPLAY MONITOR

(71) Applicant: Rockwell Collins, Inc., Cedar Rapids, IA (US)

(72) Inventors: Joshua Gerdes, Aurora, OR (US); Donald E Mosier, Cedar Rapids, IA (US); Christopher A. Keith, Wilsonville, OR (US); Michael A. Ropers, Cedar Rapids, IA (US); Brent Hansen, Eugene, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 17/319,571

(22) Filed: May 13, 2021

(65) Prior Publication Data

US 2021/0358454 A1 Nov. 18, 2021

Related U.S. Application Data

(60) Provisional application No. 63/026,579, filed on May 18, 2020.

(51) Int. Cl.
*G09G 5/10* (2006.01)
*G09G 3/32* (2016.01)

(52) U.S. Cl.
CPC ..... *G09G 5/10* (2013.01); *G09G 3/32* (2013.01); *G09G 2320/064* (2013.01); *G09G 2360/141* (2013.01); *G09G 2360/145* (2013.01)

(58) Field of Classification Search
CPC ..... G09G 5/10; G09G 3/32; G09G 2320/064; G09G 2360/141; G09G 2360/145; G09G 2320/029; G09G 2330/12; G09G 2380/12; G09G 3/006
See application file for complete search history.

(56) References Cited

U.S. PATENT DOCUMENTS 6,473,061 B1 * 10/2002 Lim ..... G09G 3/2807 345/55
8,391,416 B1 * 3/2013 Snodgrass ..... H04J 1/065 375/354
9,371,036 B2 6/2016 Schwantner
9,521,455 B1 * 12/2016 Gupta ..... H04N 21/47217
10,319,271 B2 6/2019 Dunn et al.
(Continued)

FOREIGN PATENT DOCUMENTS

CN 108608863 A 10/2018
EP 1763864 B1 12/2008
(Continued)

OTHER PUBLICATIONS

Extended Search Report dated Oct. 14, 2021 for EP Application No. 21174439.6.

*Primary Examiner* — Antonio Xavier
(74) *Attorney, Agent, or Firm* — Suiter Swant pc llo

(57) ABSTRACT

A system and method for monitoring the status of a pixelated display defines one or more pixel locations or clusters of pixels to be dithered. A monitor determines if the specified pixels or clusters of pixels demonstrate dithering. Detection of the expected dithering indicates a functional display while failure to detect the dithering indicates a failed display. Brightness levels are monitored to detect a failure in brightness leveling. Brightness is monitored at the same locations.

15 Claims, 2 Drawing Sheets

(56) References Cited

U.S. PATENT DOCUMENTS

2002/0089473 A1* 7/2002 Yamazaki ..... G09G 3/22 345/75.2
2005/0134614 A1* 6/2005 Tomohara ..... G09G 3/2014 345/690
2005/0184933 A1* 8/2005 Tomohara ..... G09G 3/3208 345/76
2006/0022992 A1* 2/2006 Tsuji ..... G09G 3/3406 345/589
2007/0052873 A1* 3/2007 Furukoshi ..... G09G 5/006 348/790
2008/0247670 A1* 10/2008 Tam ..... G06T 7/50 348/51
2009/0141987 A1* 6/2009 McGarry ..... G06V 10/7515 348/222.1
2009/0147861 A1* 6/2009 Schnebly ..... H04N 7/183 375/240.27
2009/0195483 A1* 8/2009 Naugler, Jr. ..... G09G 3/3233 345/76
2010/0266201 A1* 10/2010 Cabral ..... H04N 17/00 382/167
2011/0057951 A1* 3/2011 Bogenberger ..... G06F 3/14 345/629
2012/0001557 A1* 1/2012 Hagino ..... H05B 45/38 315/192
2013/0082615 A1* 4/2013 Williams ..... H05B 45/46 315/186
2014/0300935 A1* 10/2014 Anzai ..... H04N 1/40062 358/474
2015/0062202 A1* 3/2015 Lu ..... G09G 3/2044 345/691
2015/0339994 A1* 11/2015 Verbeure ..... G09G 5/363 345/214
2016/0282707 A1* 9/2016 Tatsumi ..... G03B 21/005
2016/0358528 A1* 12/2016 Xie ..... G09G 3/2018
2017/0023406 A1* 1/2017 Kaufman ..... G01J 5/34
2017/0188023 A1 6/2017 Brabenac et al.
2018/0314884 A1* 11/2018 Lee ..... G06V 30/1463
2019/0075290 A1 3/2019 Dubey et al.
2019/0180660 A1 6/2019 Mosier et al.
2019/0253603 A1 8/2019 Miyagaki et al.
2019/0320510 A1* 10/2019 Yang ..... H05B 45/325
2019/0385389 A1 12/2019 Fribus et al.
2020/0163178 A1* 5/2020 Bucci ..... H05B 47/175
2020/0335042 A1* 10/2020 Son ..... G09G 3/3275
2020/0349874 A1* 11/2020 Mills ..... G09G 3/006
2021/0158775 A1* 5/2021 Huang ..... G09G 3/36
2021/0193014 A1* 6/2021 Schrama ..... G09G 3/32

FOREIGN PATENT DOCUMENTS

EP 2605124 A1 6/2013
WO 2019092413 A1 5/2019
WO 2020078297 A1 4/2020

* cited by examiner

FLIPPED OR FROZEN DISPLAY MONITOR

PRIORITY

The present application claims the benefit under 35 U.S.C. § 119(e) of U.S. Provisional App. No. 63/026,579 (filed May 18, 2020), which is incorporated herein by reference.

BACKGROUND

Augmented reality avionics displays, such as head-up and helmet mounted displays, require safety monitors. A horizontally or vertically flipped or frozen display image is very hazardous, especially where the image fills a substantial portion of the pilot's field-of-view. Row/column driver monitors or light emitting diode (LED)/photodiode pairs in display corners can identify such faults in liquid crystal displays but not in monolithic displays such as microLED.

For active-matrix liquid-crystal displays, row/column driver monitors ensure the appropriate data is provided to the display crystals. Liquid-crystal on silicon displays have used LED/photodiode pairs in unused portions of an oversized display. Light is reflected off the display corners which are driven black then white at a low rate. The photodiode receives light if the corner is white; if the commanded state of the corner and the photodiode signal agree, the display is considered operational. Such approaches are not operative for microLED displays due to the displays small size, high dimming range, and monolithic design.

SUMMARY

In one aspect, embodiments of the inventive concepts disclosed herein are directed to a system and method for monitoring the status of a pixelated display. One or more pixel locations or clusters of pixels are dithered; a monitor determines if the specified pixels or clusters of pixels demonstrate dithering. Detection of the expected dithering indicates a functional display while failure to detect the dithering indicates a failed display.

In a further aspect, brightness levels are monitored to detect a failure in brightness leveling. Brightness is monitored at the same locations.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
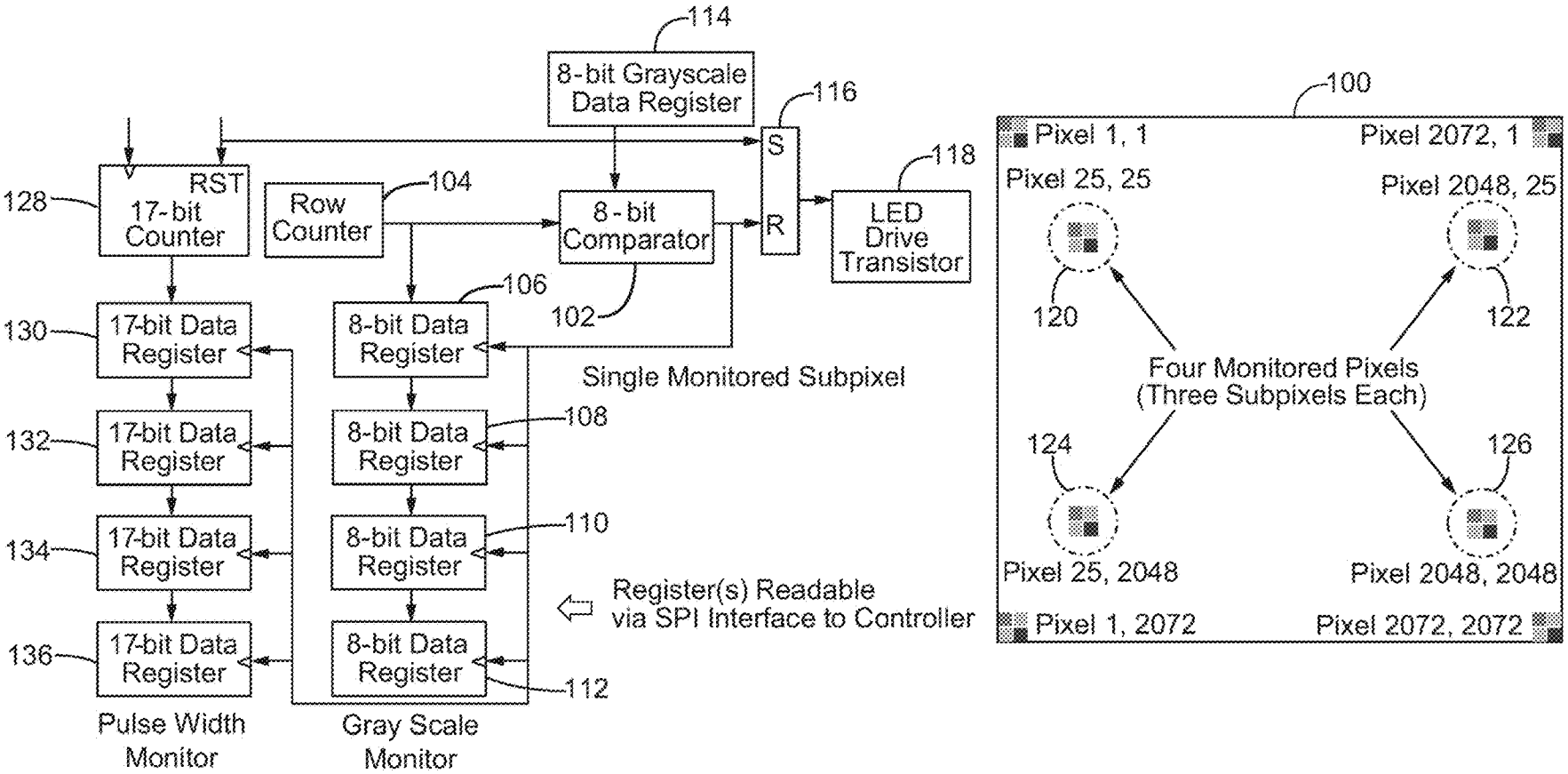
FIG. 1 shows a block diagram of an exemplary embodiment of the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system and method for monitoring the status of a pixelated display. One or more pixel locations or clusters of pixels are dithered; a monitor determines if the specified pixels or clusters of pixels demonstrate dithering. Detection of the expected dithering indicates a functional display while failure to detect the dithering indicates a failed display.

Referring to FIG. 1, a block diagram of an exemplary embodiment of the present disclosure is shown. A system utilizing an exemplary embodiment includes a pixelated display device 100 fed by one or more drive transistors 118. The one or more drive transistors 118 are fed, via a set-reset latch 116, by a comparator 102 that receives data from an image register 114 of grayscale pixel values for the display 100 and pulse-width values corresponding to the brightness of pixels. The image register 114 comprises pixel or sub-pixel values intended by a rendering engine. In at least one embodiment, a plurality of grayscale registers 106, 108, 110, 112 receives a data stream from the row counter 104 and the comparator 102; the grayscale registers 106, 108, 110, 112 are latched and shifted when the value in the image register 114 is equal to the row counter 104. The comparator 102 may receive grayscale values corresponding to one of a number of predefined pixel locations 120, 122, 124, 126 in the display 100; the pixel locations 120, 122, 124, 126 may comprise singular pixels that comprise a plurality of sub-pixels. In at least one embodiment, grayscale values in the pixel locations 120, 122, 124, 126 comprise predefined values. Grayscale values for pixels in the pixel locations 120, 122, 124, 126 are manipulated between frames, for example oscillating one bit higher or lower between frames (dithered). In at least one embodiment, a digital interface such as a serial peripheral interface reads indirect measured brightness at the pixel locations 120, 122, 14, 126 every frame and stores the information in the grayscale registers 106, 108, 110, 112; in at least one embodiment, information is retained for the last three frames and a current frame. It may be appreciated that similar architecture may be used to monitor each of the pixel locations 120, 122, 124, 126.

The comparator 102 may monitor the row counter 104 for the known, predefined values in the corresponding pixel location 120, 122, 124, 126; when the value of the row counter 104 and the value from the image register 114 are determined to be equal via the comparator 102, data values are latched to one of the grayscale registers 106, 108, 110, 112. The grayscale registers 106, 108, 110, 112 are then analyzed to identify dithering between frames. If dithering is identified at the pixel locations 120, 122, 124, 126, the display 100 is known to be properly oriented and properly refreshing. If dithering is not detected at one or more of the pixel locations 120, 122, 124, 126, the display may be faulty. Faulty orientation may include the image on the display 100 being flipped either horizontally or vertically, or the image being misaligned on the display 100 (for example by shifting pixels an image register) such that the dithered pixels do not correspond to the monitored pixel locations 120, 122, 124, 126.

For example, a pixel at a pixel location 120, 122, 124, 126 is set to grayscale '240'. The image register 114 is configured for a grayscale value of '240'. The comparator 102 waits for the value of the row counter 104 to reach '240'. When the row counter 104 reaches '240,' the comparator 102 shuts off the LED driver transistor 118, causing the '240' value in the row counter 104 to latch in grayscale register 106. Prior latched values in the grayscale registers 106, 108, 110, 112 may be shifted such that a first register 106 holds the most recent latched value, a second register 108 holds the most recent prior value, etc. The process is repeated for multiple frames. Those grayscale registers 106, 108, 110, 112 may be analyzed to identify dithering grayscale values between '240' and '241' every other frame.

It may be appreciated that, because the system is designed to identify a vertically or horizontally flipped image, the pixel locations 120, 122, 124, 126 may be offset from each other along one or more axes such that pixel locations 120, 122, 124, 126 do not align if flipped. Alternatively, or in addition, individual pixel locations 120, 122, 124, 126 may be supplied with dithered grayscale values at different times and/or over different sets of frames. Furthermore, it may be appreciated that in some applications, images are not rendered to edge of the display 100, therefore the pixel locations 120, 122, 124, 126 may be inset from the edge of the display 100 some number of pixels to ensure the pixel locations 120, 122, 124, 126 fall within the rendered area.

In at least one embodiment, the system may also monitor display brightness. A separate pulse-width counter 128 may feed pulse-width values to a separate set of pulse-width registers 130, 132, 134, 136. Unexpected brightness changes as represented by pulse-width may be identified via analysis of the pulse-width registers 130, 132, 134, 136. Alternatively, or in addition, a ratio of grayscale values to pulse-width values may be analyzed for unexpected changes between frames; for example, a ratio of grayscale values in a first grayscale register 106 to pulse-width values in a first pulse-width register 130 is compared to a ratio of grayscale values in a second grayscale register 108 to pulse-width values in a second pulse-width register 132. In at least one embodiment, the pulse-width counter 128 may be driven via a clock frequency rather than a row count.

In at least one embodiment, the pixel locations 120, 122, 124, 126 may each correspond to a set of sub-pixels that operate in concert to form a single image pixel. The processes described herein may be applied to image pixels or individual sub-pixels within the pixel locations 120, 122, 124, 126.

Figure 2:
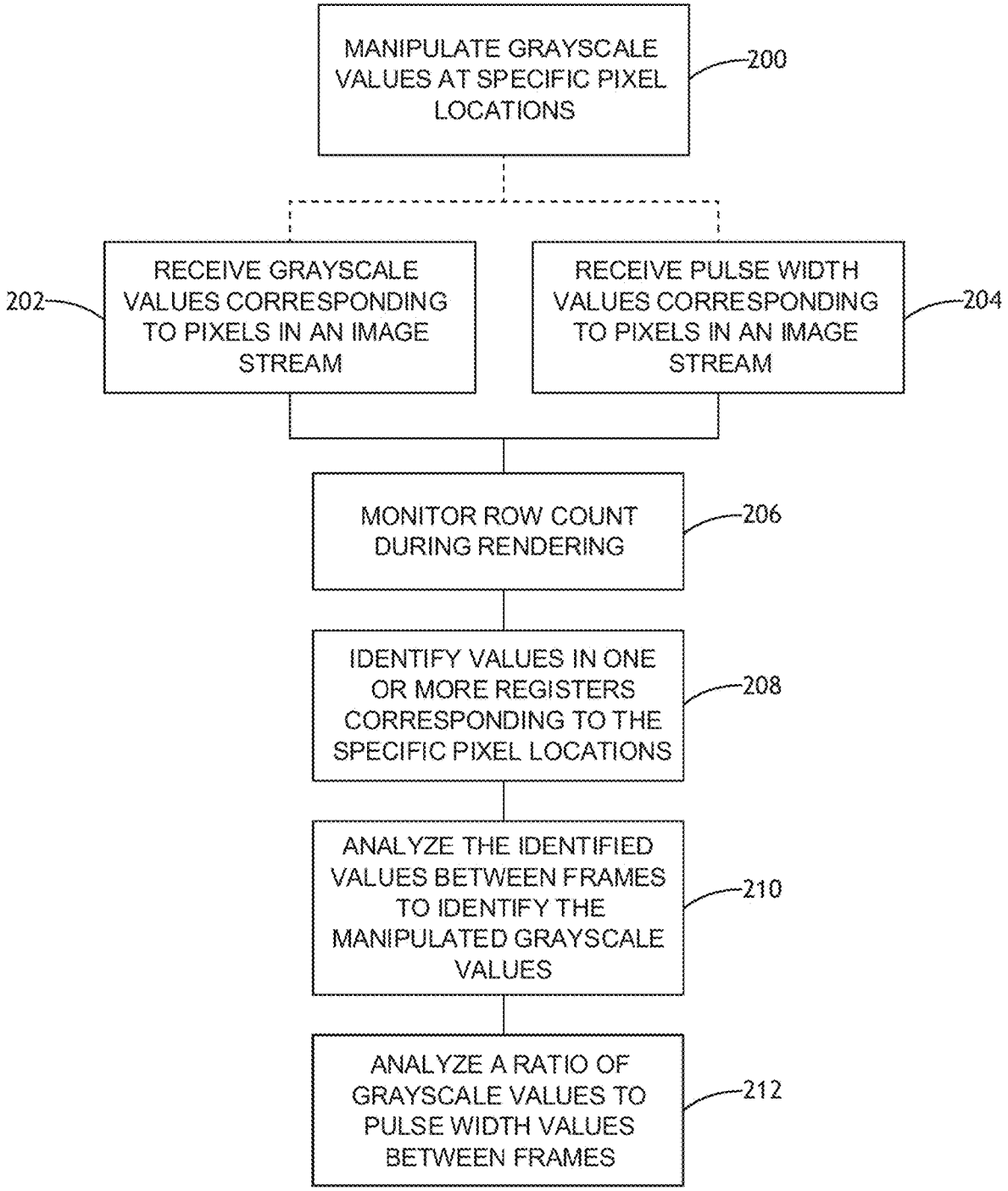
FIG. 2 shows a flowchart of a method for monitoring a display according to an exemplary embodiment.

Referring to FIG. 2, a flowchart of a method for monitoring a display according to an exemplary embodiment is shown. Frames in an image stream are manipulated 200 by the image source such that grayscale values for pixels at one or more specific locations are dithered between frames. In at least one embodiment, grayscale values are shifted up or down some detectable but unobtrusive amount every other frame. This yields an average pixel intensity nearly equal to the original image value. For example, in the case of a black pixel, the value alternates from black to grayscale 1. The image stream is then sent to a display system.

The display system receives 202, 204 grayscale values and pulse-width values corresponding to pixels in the image stream. While a system of LED drive transistors applies the grayscale and pulse-width values to pixels in the display, a row counter monitors 206 the row of pixels currently being driven and records grayscale values and/or pulse-width values corresponding to the pixels in the specific locations in registers. A monitoring processor/controller identifies 208 values in the one or more registers corresponding to the specific locations and analyzes 210 the identified values between frames via measured pixel on-time and/or current monitoring.

In at least one embodiment, when the LED in a pixel is enabled, the row counter increments. Once the row counter is equal to the value in a grayscale register, the LED in the pixel is disabled and the row counter value is latched into a grayscale monitor register. In at least one embodiment, the monitoring processor/controller may also increment a pulse-width counter and latch the pulse-width value to a corresponding monitor register. In at least one embodiment, four frames worth of the grayscale and pulse-width values are retained, offering four frames of history for each monitored pixel. Grayscale and pulse-width registered values allow for brightness of the pixel to be inferred and for the pixel grayscale to be monitored by the processor/controller. Either or both of these registered values may be used to verify whether the specific pixels are appropriately dithering up and down in grayscale or luminance.

When the display system is operating properly, the analysis 210 indicates grayscale manipulation at the specific locations, such as dithering between frames. When the display system is suffering an orientation fault (shifted pixels, vertical or horizontal flipping, etc.) or when the display system is frozen, the grayscale manipulation will not be identified.

In at least one embodiment, when a fault is detected, a fault message may be sent to an avionics system. Alternatively, or in addition, when a fault is detected the display may be deactivated or deemphasized (such as by reducing brightness) to prevent the faulted display from distracting the pilot.

In at least one embodiment, the monitoring processor/controller may analyze 212 pulse-width values or a ratio of grayscale values to pulse-width values over time at the specific locations. Unexpected changes to the pulse-width values or the ratio between frames may indicate a brightness fault in the display system.

Embodiments of the present disclosure facilitate microLED technology for avionics displays by offering a critical safety monitor.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A display comprising:

a pixelated display;

at least one processor in data communication with the pixelated display and at least one set of registers, the at least one processor to:

receive a stream of image frames;

record, in a first register, a first grayscale value corresponding to a first pixel location in the pixelated display, the first grayscale value derived from a first image frame;

compare the first grayscale value to a commanded first grayscale value for the first pixel location in the first image frame;

record, in a second register, a second grayscale value corresponding to the first pixel location in the pixelated display, the second grayscale value derived from a second image frame;

compare the second grayscale value to a commanded second grayscale value for the first pixel location in the second image frame; and determine if one or more image frames are flipped, wherein:

the commanded first grayscale value and the commanded second grayscale value are manipulated to guarantee a disparity between the first image frame and the second image frame; and determining if one or more image frames are flipped is based on a failure to identify the expected grayscale manipulation.

2. The display of claim 1, wherein:

the at least one processor is further configured to continuously monitor grayscale values at the first pixel location over time; and the manipulation comprises oscillating higher or lower between frames.

3. The display of claim 1, wherein the first pixel location is inset from an edge of the pixelated display.

4. The display of claim 1, wherein the at least one processor is further configured to:

record, in a separate first register, a third grayscale value corresponding to a second pixel location in the pixelated display, the third grayscale value derived from the first image frame;

compare the third grayscale value to a commanded third grayscale value for the second pixel location in the first image frame;

record, in a separate second register, a fourth grayscale value corresponding to the second pixel location in the pixelated display, the fourth grayscale value derived from the second image frame; and compare the fourth grayscale value to a commanded fourth grayscale value for the second pixel location in the second image frame.

5. The display of claim 1, wherein the at least one processor is further configured to determine if one or more image frames are frozen based on a failure to identify the expected grayscale manipulation.

6. The display of claim 1, further comprising a serial peripheral interface to interface the pixelated display to the at least one processor.

7. The display of claim 1, wherein the pixelated display comprises a microLED device.

8. A system comprising:

a pixelated display;

at least one processor in data communication with the pixelated display and at least one set of registers, the at least one processor to:

record, in a first register, a first grayscale value corresponding to a first pixel location in the pixelated display, the first grayscale value derived from a first image frame;

compare the first grayscale value to a commanded first grayscale value for the first pixel location in the first image frame;

record, in a second register, a second grayscale value corresponding to the first pixel location in the pixelated display, the second grayscale value derived from a second image frame;

compare the second grayscale value to a commanded second grayscale value for the first pixel location in the second image frame;

record, in a first pulse-width register, a first pulse-width value corresponding to the first pixel location in the first image frame;

record, in a second pulse-width register, a second pulse-width value corresponding to the first pixel location in the second image frame; and compare a first ratio comprising the first grayscale value and first pulse-width value to a second ratio comprising the second grayscale value and the second pulse-width value to identify unexpected brightening, wherein the commanded first grayscale value and the commanded second grayscale value are oscillated higher or lower between frames to guarantee a disparity between the first image frame and the second image frame.

9. The system of claim 8, wherein the at least one processor is further configured to execute a row counter to extract grayscale values from first image frame and second image frame at the first pixel location.

10. The system of claim 8, wherein the at least one processor is further configured to compare the first pulse-width value to the second pulse-width value to identify unexpected brightening.

11. The system of claim 8, wherein the at least one processor is further configured to execute a frequency-based pulse-width counter to extract pulse-width values from first image frame and second image frame.

12. The system of claim 8, wherein the at least one processor is further configured to execute a remedial action when the expected grayscale oscillation is not detected.

13. A method for identifying a display fault comprising:

recording, in a first register, a first grayscale value corresponding to a first pixel location in a pixelated display, the first grayscale value derived from a first image frame;

comparing the first grayscale value to a commanded first grayscale value for the first pixel location in the first image frame;

recording, in a second register, a second grayscale value corresponding to the first pixel location in the pixelated display, the second grayscale value derived from a second image frame;

comparing the second grayscale value to a commanded second grayscale value for the first pixel location in the second image frame;

recording, in a first pulse-width register, a first pulse-width value corresponding to the first pixel location in the first image frame;

recording, in a second pulse-width register, a second pulse-width value corresponding to the first pixel location in the second image frame;

comparing the first pulse-width value to the second pulse-width value to identify unexpected brightening; and comparing a first ratio comprising the first grayscale value and first pulse-width value to a second ratio comprising the second grayscale value and the second pulse-width value to identify unexpected brightening, wherein the commanded first grayscale value and the commanded second grayscale value are oscillated higher or lower between frames to guarantee a disparity between the first image frame and the second image frame.

14. The method of claim 13, further comprising executing a row counter to extract grayscale values from first image frame and second image frame at the first pixel location.

15. The method of claim 13, further comprising execute a frequency-based pulse-width counter to extract pulse-width values from first image frame and second image frame.

* * * * *